United States Patent [19]

Wilson et al.

[11] Patent Number: 4,513,577

[45] Date of Patent: Apr. 30, 1985

[54] EVAPORATOR AND METHOD OF OPERATION

[76] Inventors: Neill R. Wilson; Susan E. Wilson, both of P.O. Box 538, Berryville, Va. 22611

[21] Appl. No.: 443,025

[22] Filed: Nov. 19, 1982

[51] Int. Cl.[3] ..... F25D 17/06; F28D 3/00

[52] U.S. Cl. ..... 62/91; 62/171; 62/226; 62/281

[58] Field of Search ..... 62/304, 305, 309, 311, 62/281, 91, 314, 171, 272, 176.4, 226, 228

[56] References Cited

U.S. PATENT DOCUMENTS 2,382,502 8/1945 Philipp ..... 62/311

3,747,362 7/1973 Mercer ..... 62/309

*Primary Examiner*—Henry Bennett

*Attorney, Agent, or Firm*—Fay & Sharpe

[57] ABSTRACT

This invention relates to an evaporator coil structure for use in building air conditioner systems which improves the operating efficiency of the system, as well as to a method of cycling the on and off operation of the system's compressor to further improve its overall operating efficiency.

More specifically a coil structure is provided that will inherently save a large portion of the energy normally wasted due to the energy absorbed by condensation of moisture as air is conducted through the coil.

12 Claims, 4 Drawing Figures

EVAPORATOR AND METHOD OF OPERATION

BACKGROUND OF INVENTION

This invention broadly relates to such prior art devices as those disclosed in U.S. Pat. Nos. 4,089,188 and 2,920,459 wherein means associated with evaporator coil structures are provided to handle and dispose of condensate. In U.S. Pat. No. 2,920,459 a slight amount of energy is saved due to lower conduction losses through wall 3 of the cabinet, but our invention is a much improved and more direct approach to the problem of energy waste due to the energy absorbed by the change of state of vapor to liquid as vapor from the air is condensed on the exchanger surfaces of the evaporator coil.

SUMMARY OF THE INVENTION

This invention is directed to an evaporator structure wherein drops of condensate that form on the evaporator fins are conducted by gravity flow along grooves formed in the fins directly to a mesh type absorbent material that is air permeable. The absorbent material is positioned directly in the air stream on the down-stream side of the evaporator, and therefore the condensate collected by the absorbent material is dispersed by the material and at the same time exposed to air contact with the cooled air before it is passed to the room or building space being cooled. This air to moisture exposure or contact results in a large portion of the condensed moisture being re-evaporated into the cooled air stream whereby the air is further cooled by evaporation. This increases system efficiency because energy lost in condensation of moisture is re-gained by the evaporation of the same moisture.

This invention is further directed to a means for cycling the refrigeration cycle compressor (and/or refrigerant circulator pumps) on and off while maintaining air flow through the evaporator coil. Moisture sensors are provided on the mesh material or below the mesh to sense an over-saturation of the mesh with water. When this occurs, the compressor is automatically turned off while the fan remains running, whereby air is circulated through the mesh until the moisture content of the mesh is significantly reduced.

DETAILED DESCRIPTION OF THE INVENTION

Figure 1:
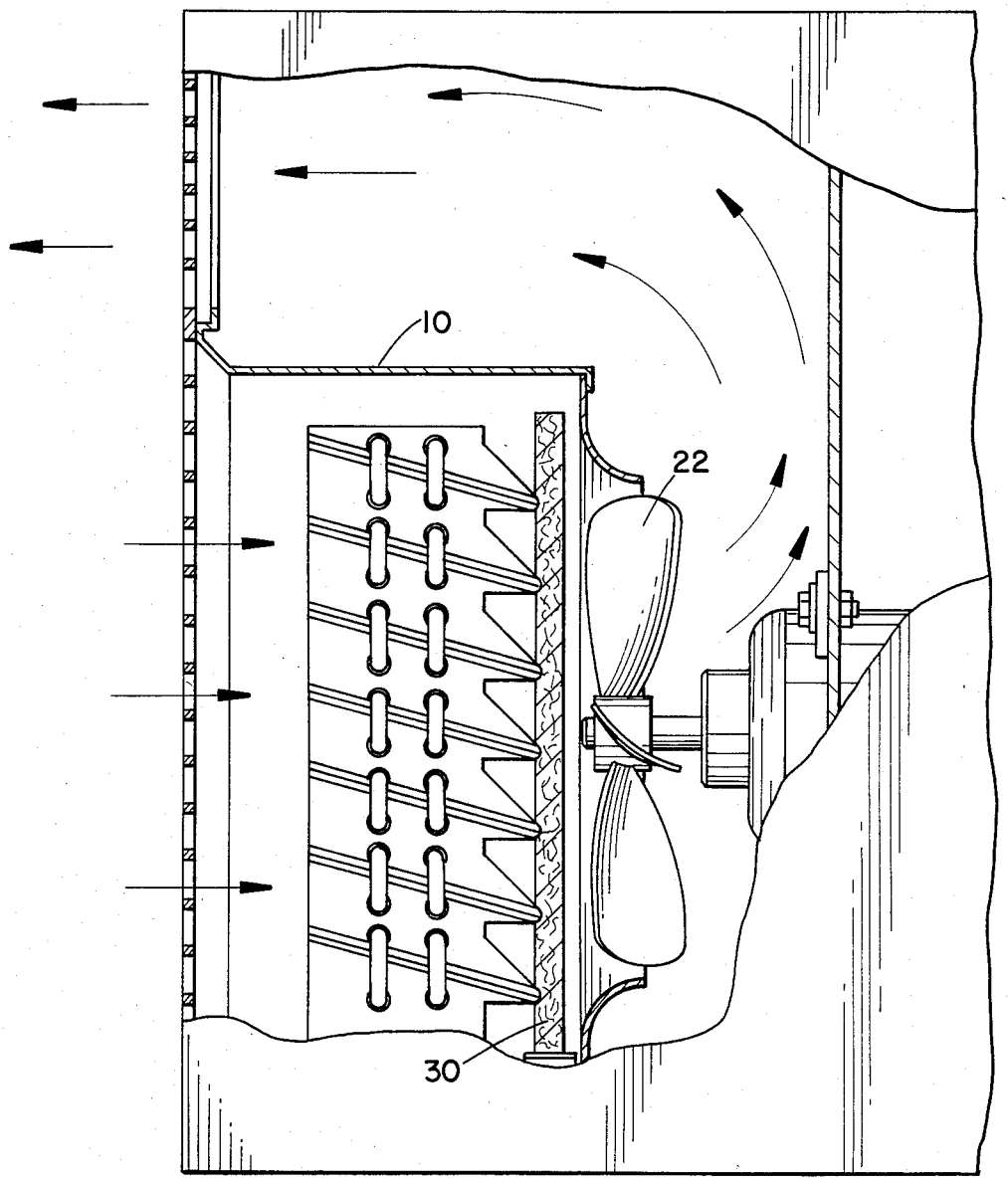
FIG. 1 is a cross-sectional view of a portion of a window type air conditioner which shows evaporator coil, mesh material and air fan for drawing air through the evaporator and mesh.

Referring now to the drawings,

In FIG. 1 a portion of a window type air conditioner or heat pump is shown. Room air is drawn in from the left side of the unit by fan 22. The room air first passes through evaporator unit 10, and then passes through mesh 30 (mesh 30 is ideally a loose felt type material made of plastic or glass fibers). After passing through the mesh, the now cooler air is passed back to the room or space being cooled. As is well known in the art, fresh air could be mixed with the incoming air or cooled air at any point in the cycle.

The evaporator shown in FIG. 1 is basically a well known fin-on-tube structure used in most air-conditioners and heat pumps today. A refrigerant such as Freon is conducted through the tubes in the evaporator wherein it evaporates and thereby absorbs heat from the fins and air passing through the evaporator. As air contacts the metal fins moisture is condensed on the metal surfaces. In most prior art devices, this moisture runs down the fin surfaces by gravity and thereafter runs into a collection pan on the underside of the evaporator. From the pan a trough or tube is provided to a point where it drops outside of the building.

In our evaporator structure the fins 12 are each provided with a series of inclined ridges stamped in double grooves which act as water conducting ridges or grooves. In operation moisture will condense on the fin sides, flow down to a groove and follow the groove back down its incline to the points provided on each fin and from there flow into the mesh material. The mesh functions to disperse the water over a wide area and thereby greatly increase the surface area of water to air contact.

Figure 3:
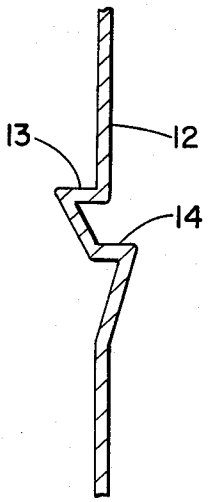
FIG. 3 is a partial sectional view of one fin showing the double groove formed in the fin.

As best shown in FIG. 3, each fin is provided with a series of double grooves. These grooves provide water catching normal surfaces 13 and 14 which will catch water drops flowing down each side of each fin. These surfaces and associated grooves then act as conduits to pass the water toward and on into the mesh material.

Figure 2:
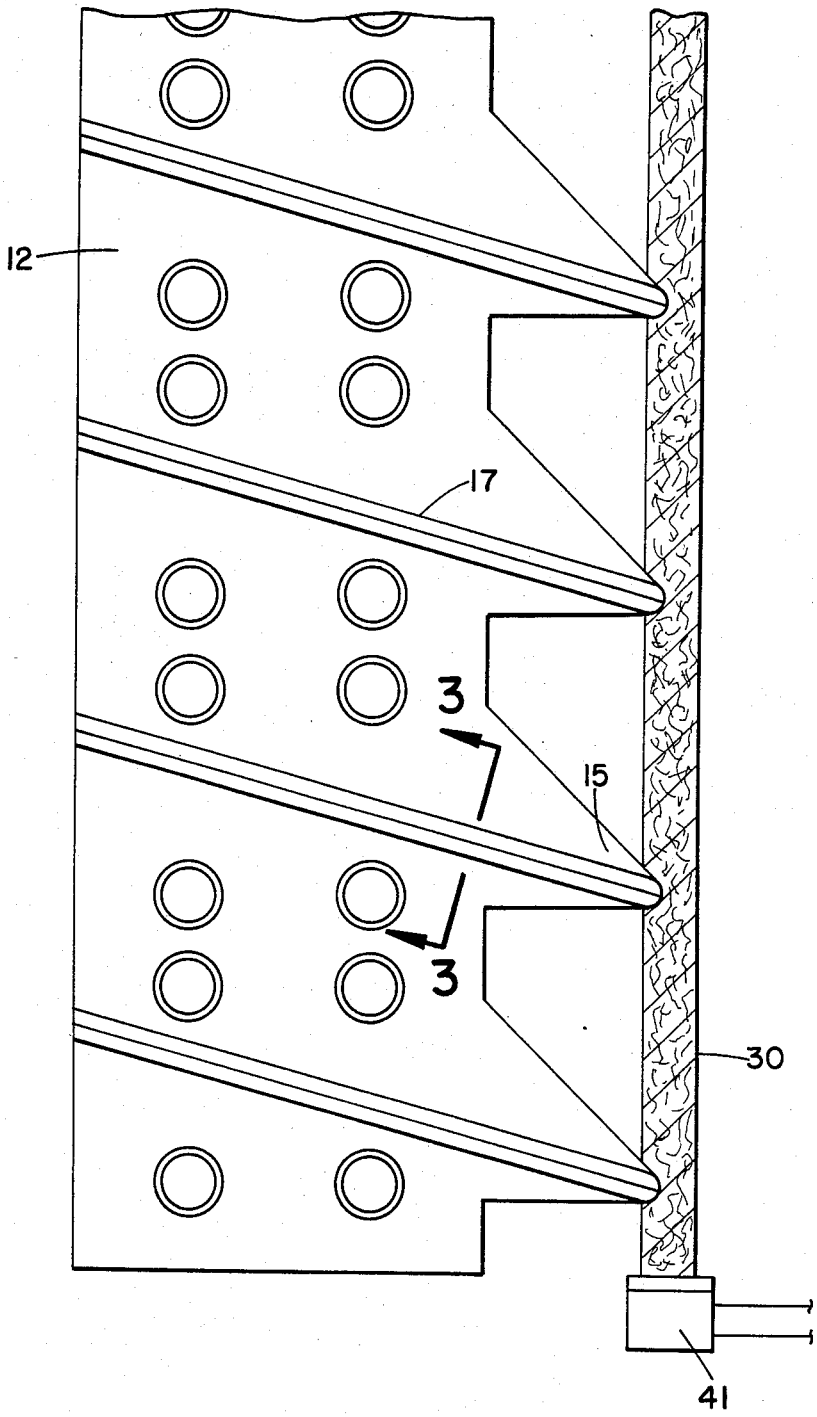
FIG. 2 is a side view of a portion of one fin with the fin mounted adjacent to the mesh material.

As best shown in FIG. 2, each fin may also be provided with a series of points 15 which in effect act as spacers to space the mesh material back away from the main body of the evaporator fins to thereby allow better air flow into and around the mesh material. This spacing also prevents dirt from building up and sticking between the fins on the upstream side of the mesh. The mesh material must be made and mounted in such a manner that it is easily removed for cleaning and/or replacement.

Providing the grooves 17 with an incline relative to the plane of main evaporator 10 structure as shown allows the grooves to function properly with the evaporator mounted vertically, horizontally or inclined.

Figure 4:
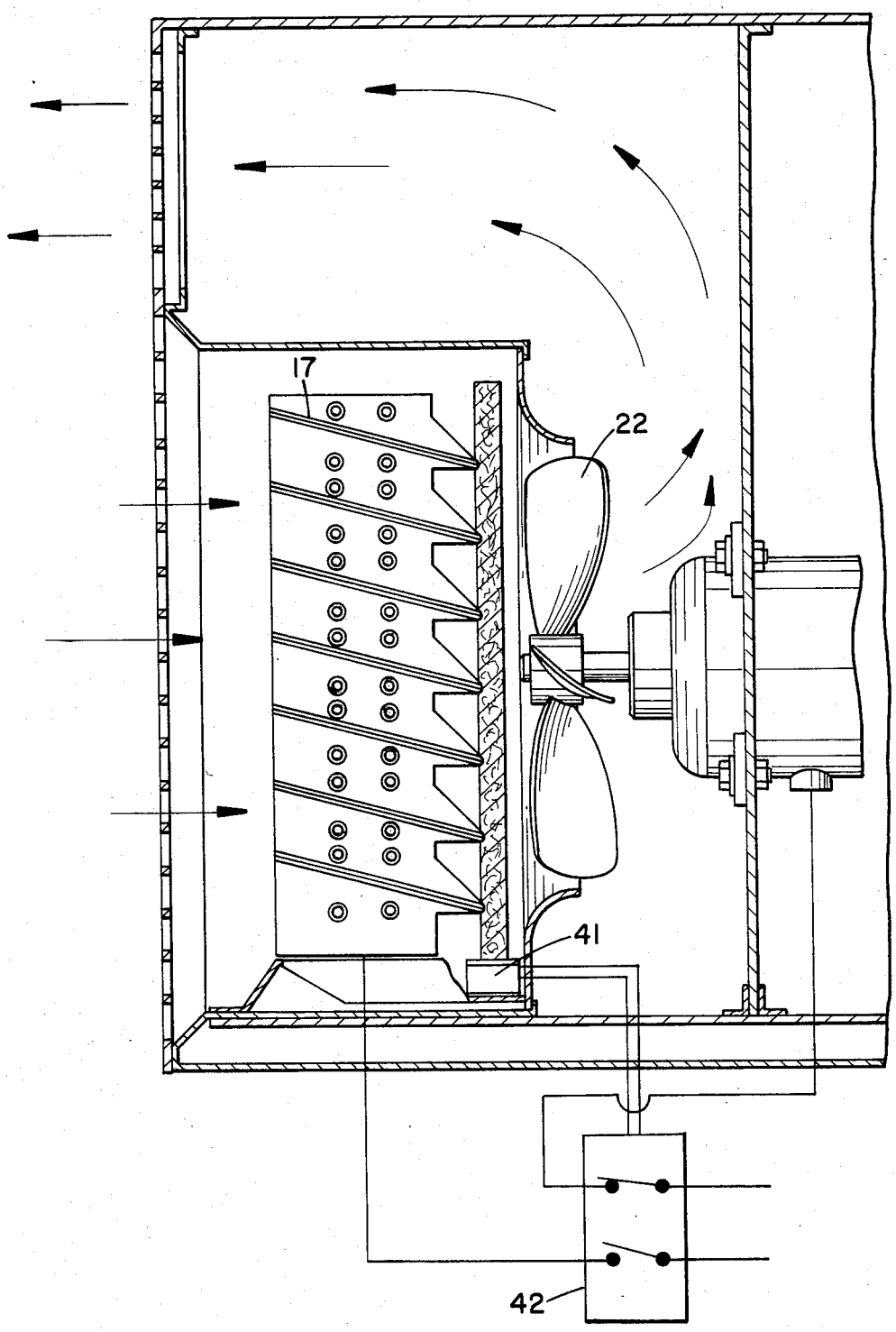
FIG. 4 is a cross-sectional view of the window-type air conditioner like FIG. 1 showing a control circuit for the evaporator.

An additional feature of this invention is the provision of a moisture sensor 41 located on the mesh material or located in a catch pan below the mesh material which operates a timer that cuts off the refrigeration compressor for a predetermined time each time an excess build up of moisture is sensed on the mesh (or dripping from the mesh). As shown in FIG. 4, the air moving fan remains on while the compressor is cycled off by a control circuit 42, whereby the excess moisture is evaporated from the mesh. This feature saves energy because it allows essentially all of the condensed moisture to be re-evaporated.

One of the main advantages of this invention is that the structure involved is very simple and adds little to the overall manufacturing cost of an air conditioning unit. Another advantage is that no water or moisture is allowed to stand in a static pool where bacteria can build up and cause serious health problems. Also readmitted moisture can be beneficial where too low humidity is a problem. Thus bacteria, fungi, and too low humidity are eliminated as our invention re-evaporates the moisture almost immediately.

The invention has been described with reference to a preferred embodiment. Obviously, modifications and alterations will occur to others upon a reading and understanding of this specification. It is intended to include all such modifications and alterations insofar as they come within the scope of the appended claims or the equivalents thereof.

We claim:

1. A method of cooling moisture containing air comprising:

passing said air over a metal surface which is cooled by evaporation of a refrigerant, whereby the moisture condenses on said surface;

conducting said condensate to a point on the downstream air side of said surface;

thereafter dispersing said condensate whereby said condensate re-evaporates into said air; and, stopping the evaporation of said refrigerant for a period of time when an excess of condensate builds up on the downstream air side of said surface.

2. A heat exchanger for use as an evaporator comprising:

a plurality of refrigerant conducting tubes;

a plurality of fins mounted on said tubes;

means for flowing air thru said mesh material;

an air permeable mesh material positioned adjacent said fins and on the downstream side of said fins;

means for conducting condensate from said fins to said mesh, said means including a plurality of spaced inclined ridges provided on said fins; and, control means for stoping the operation of the evaporator when the moisture level exceeds a predetermined maximum in said mesh material.

3. The heat exchanger of claim 1 wherein said fins each comprise a rectangular piece of sheet metal having elongated identations stamped therein each of which extends from a point near one long side of the rectangle to a point on the opposite long side of the rectangle.

4. The heat exchanger of claim 3 wherein the elongated identations extend at an angle to one long side of the rectangle.

5. The heat exchanger of claim 3 wherein one side of the fin includes a series of triangular points extending from the side and wherein the identations extend into the triangles.

6. The heat exchanger of claim 5 wherein said points serve to space said mesh material away from a main portion of said fins thus allowing better air flow into and through said mesh material.

7. The heat exchanger of claim 2 wherein said mesh material is readily removable from the heat exchanger for cleaning and replacement.

8. The heat exchanger of claim 2 wherein said means for flowing air comprises a fan which moves air through said mesh material.

9. The heat exchanger of claim 2 wherein said control means includes a moisture sensor and a control circuit.

10. The method of claim 1 wherein said condensate is conducted to a mesh material.

11. The method of claim 10 further comprising the step of passing air through said mesh material.

12. The method of claim 11 wherein said air continues to be passed through said mesh material even when the evaporation of said refrigerant is stopped.

* * * * *